US005967767A

United States Patent [19]

Khon

[11] Patent Number: 5,967,767

[45] Date of Patent: Oct. 19, 1999

[54] CIGARETTE LIGHTER CLOSURE DEVICE

[76] Inventor: Trinh Cam Khon, 1739 Aprilsong Ct., San Jose, Calif. 95131

[21] Appl. No.: 09/060,935

[22] Filed: Apr. 15, 1998

[51] Int. Cl.[6] ..... F23Q 25/00; E05C 17/56

[52] U.S. Cl. ..... 431/152; 431/129; 431/253; 431/151; 220/230; 292/251.5

[58] Field of Search ..... 431/253, 255, 431/129, 130, 135, 144, 146, 152, 151; 220/230; 292/251.5; 206/85, 87, 89

[56] References Cited

U.S. PATENT DOCUMENTS

| | | | |
|---|---|---|---|
| 2,032,695 | 3/1936 | Gimera et al. | 67/7.1 |
| 3,749,301 | 7/1973 | Peckar | 292/251.5 |
| 3,758,262 | 9/1973 | Harris | 431/130 |
| 3,763,996 | 10/1973 | Shepherd | 206/87 |
| 3,879,163 | 4/1975 | Wright | 431/267 |
| 3,899,285 | 8/1975 | Christmas | 431/152 |
| 4,150,940 | 4/1979 | Heller et al. | 431/130 |
| 4,350,171 | 9/1982 | Kemmel | 206/250 |
| 5,424,929 | 6/1995 | Murray et al. | 362/200 |
| 5,534,663 | 7/1996 | Rivers et al. | 220/230 |

*Primary Examiner*—Carl D. Price
*Assistant Examiner*—Josiah C. Cocks
*Attorney, Agent, or Firm*—Jeffrey P. Aiello; Carol D. Titus; James J. Leary

[57] ABSTRACT

An improved portable cigarette lighter closure device that provides facile pivoting of the cover between open and closed positions, and which securely retains the cover in the closed position is provided. The closure device incorporates a magnet affixed in the cover of a cigarette lighter, for securing the cover to a body of the lighter and to securely retain the cover in the closed position. The magnet exerts sufficient force on the body to retain the cover in the closed position, while enabling one handed pivoting of the cover by the user. Additionally the invention may be provided with an insulating sleeve. The ferromagnetic insulating sleeve prevents the magnetic field radiated by the magnet from passing through the cover of the lighter, for preventing magnetically attracted objects located in a pocket of the user's clothing such as the users keys and change for example, from being inadvertently drawn against the cover of the lighter.

14 Claims, 2 Drawing Sheets

CIGARETTE LIGHTER CLOSURE DEVICE

BACKGROUND OF THE INVENTION

1. Field of the Invention

The present invention relates generally to portable cigarette lighters, and more particularly, to an improved portable cigarette lighter closure device.

2. Description of Related Art

Portable cigarette lighters that are dimensioned to be carried in a user's pocket are well known. These portable lighters are useful for lighting cigarettes and pipes, among several other items that may be desired to be ignited by the user. One well known embodiment of these lighters comprises an ignition assembly and a reservoir assembly that contains flammable lighter fluid. The ignition assembly includes a draft guard for preventing a flame created by the lighter from being inadvertently extinguished. A wick extends from the reservoir and into the draft guard. A toothed wheel is typically provided to engage a flint. The toothed wheel is rotated to cause the flint to throw sparks into the draft guard and toward the wick, causing the saturated wick to ignite.

The reservoir assembly may comprise a casing or cell having the lighter fluid retained therein, with a portion of the wick floating in the fluid. Alternatively, a known absorbent material, such as felt, is disposed in the casing and saturated with lighter fluid. The wick again is in communication with the saturated felt, and is ignited as discussed above.

Additionally, these lighters are provided with a pivoting cover. The cover is provided to enable the user to extinguish the flame emanating from the ignition assembly when desired, and to protect the ignition assembly and the users clothing. A lever is provided to prevent the cover from inadvertently opening and closing. The lever is often configured with a laterally projecting toe portion that communicates with a spring biased plunger for resisting pivotable movement of the lever, between a horizontal position of the lever when the cover is open, and a vertical position when the cover is closed. The toe portion of the lever depresses the spring with the plunger for resisting the lever's pivotable movement. The spring also causes the plunger to exert sufficient force on the lever to retain the lever in the vertical position and in the horizontal position.

A number of U.S. Patents have be granted to such portable lighters. For example, U.S. Pat. No. 2,032,695, to Gimera et al. discloses a pocket lighter that includes a hinged cover and means for retaining the cover in a closed position and an open position. The retaining means disclosed therein is substantially similar to the lever and spring biased plunger assembly discussed above.

Another portable lighter is disclosed in U.S. Pat. No. 5,424,929, to Murry et al. The lighter disclosed therein includes a cover pivotably coupled to an insulative case for housing a power supply, such as batteries, and conductors. A spring biased plunger is again in communication with a lever to prevent the cover from inadvertently opening and closing. The lever is configured to communicate with the plunger for resisting pivotable movement of the lever, and to maintain the lever in a horizontal position when the cover is open, and in the vertical position when the cover is closed.

U.S. Pat. No. 4,150,940, to Heller et al., discloses a cigarette lighter that includes a cap-type member that is pivotally mounted on the open end of a housing. The cap-type member includes a lug extending outwardly through an opening in the housing. The lug bears against an edge of the opening. The edge of the opening provides a fulcrum about which the lug and, in turn, the cap-type member pivots into the housing. The cap-type member is in engagement with the ignition mechanism so that it actuates the ignition mechanism when it is pivoted into the housing.

U.S. Pat. No. 3,899,285, to Christmas, is directed to a cigarette-lighter cover that is provided in a generally planar configuration. The cover has an internally formed hinge that enables a portion of the cover to be swung thereabout to expose a portion of the lighter and a protuberance which may be snapped into a recess in the lighter to releasably hold the cover in place.

U.S. Pat. No. 3,879,163, to Wright, discloses a lighter assembly that includes means for directing primary and secondary fuels along convergent paths toward an ignition point to produce a lighter flame.

However, a disadvantage common to the prior art, and particularly to portable lighters that include a pivoting cover and a lever which aids with retaining the cover of the lighter in the open and closed positions, is that it is often somewhat difficult for the user to open and close the cover. Frequently, the spring biases the plunger with enough force to prevent facile opening and closure of the cover. Thus, the force exerted by the plunger on the lever often necessitates that the user simultaneously hold the lighter fluid reservoir portion of the lighter along with the cover of the lighter, so that they can rotate the cover relative to the body. Therefore, one-handed operation of the lighter is prevented.

Thus, there exists a need for a portable cigarette lighter cover closure device that provides facile actuation of the cover and which securely retains the cover in the closed position.

OBJECTS OF THE INVENTION

It is therefore an object of the present invention to provide an improved portable cigarette lighter closure device;

It is another object of the present invention to provide a portable cigarette lighter cover closure device that provides facile actuation of the cover;

It is a further object of the present invention to provide a portable cigarette lighter cover closure device that provides facile actuation of the cover and which securely retains the cover in the closed position; and It is still another object of the present invention to provide a portable cigarette lighter cover closure device that enables one-handed actuation of the cover.

SUMMARY OF THE INVENTION

These and other objects and advantages of the present invention are achieved by providing an improved portable cigarette lighter closure device that provides facile pivoting of the cover between an open position and closed position, and which securely retains the cover in the closed position. The closure device of the present invention incorporates a magnetic field radiating means in the cover of a portable cigarette lighter, for securing the cover to a body of the lighter, to securely retain the cover in the closed position. The magnetic field radiated by the radiating means is of sufficient strength to retain the cover against the body of the lighter and to maintain the cover in the closed position, while still enabling one handed pivoting of the cover by the user for opening the cover.

The present invention obviates the need for a spring biased lever, as was common to the prior art. Thus, the user does not have to exert substantial force on the cover to open the cover. In the present invention, when the user pivots the cover from the closed position to the open position, the force that the magnetic means exerts on the lighter body uniformly decreases to allow facile pivoting of the cover to the open position. To close the cover, the user rotates the cover toward the body. As the cover is rotated toward the body, the strength of the magnetic field radiating from the magnetic means draws the cover against the body of the lighter, securely retaining the cover in the closed position.

The invented device may be incorporated into a portable cigarette lighter of any one of several well known configurations that includes a cover and a body. In the preferred embodiment, the present invention is incorporated in to a portable cigarette lighter, such as the lighter disclosed in U.S. Pat. No. 2,032,695, wherein the lighter includes a hollow cover that is pivotably coupled to a body. The body includes an ignition assembly and a reservoir assembly for holding a flammable lighter fluid. The ignition assembly includes an upwardly extending draft guard that prevents flames created by the lighter from being inadvertently extinguished. The cover includes a top wall, a pair of side walls, a rear wall, and a front wall. A hinge is coupled to an edge of the rear wall and to an edge of the body for pivotably coupling the cover to the body.

In the present invention, the magnetic means is positioned in the interior of the cover and adjacent to the front wall and top wall thereof. Preferably, the magnetic means is positioned in the cover adjacent to the draft guard, without abutting the draft guard when the cover is in the closed position. The location of the magnetic means, or north or south poles of the magnet, enables the magnetic means to exert sufficient magnetic force on the draft guard for retaining the cover in the closed position, while preventing damage from coming to the magnetic means due to heating by the elevated temperature of the draft guard.

In the preferred embodiment of the present invention, the magnetic means comprises a known metallic magnetic, hereinafter referred to as a magnet, that is dimensioned to be retained in the interior of the cover.

Additionally, the device of the present invention may be provided with means for preventing the magnetic field radiated by the magnet from passing through the cover of the lighter. A ferromagnetic insulating sleeve may be interposed between the magnet and the top and front walls of the cover. The ferromagnetic insulating sleeve prevents the magnetic field radiated by the magnet from passing though the top and side walls of the cover to prevent magnetically attracted objects located in a pocket of the user's clothing, such as the users keys and change for example, from being inadvertently drawn against the cover of the lighter. Further, the magnet may be coupled to the sleeve, with the sleeve coupled to the top and side walls of the cover, for securing the magnet to the cover.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes presently contemplated by the inventor of carrying out his invention. Various modifications, however, will remain readily apparent to those skilled in the art, since the generic principles of the present invention have been defined herein.

Figure 1:
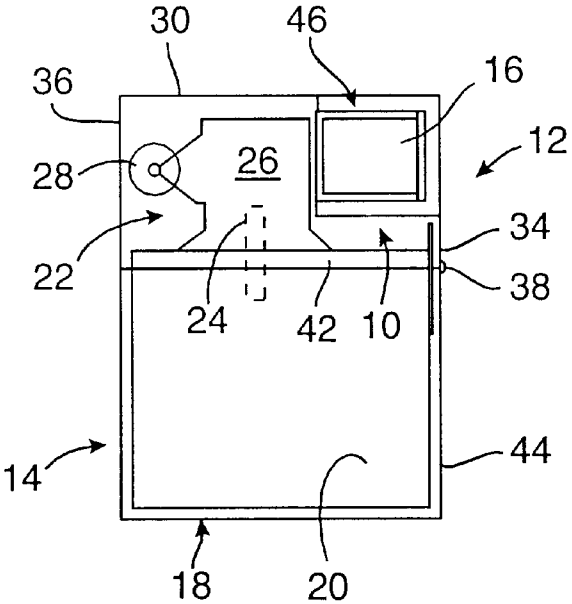
FIG. 1 is a side elevational, schematic view of a portable cigarette lighter embodying a preferred embodiment of the closure device of the present invention.

Referring now to the drawing Figures, and particularly to FIG. 1 of the drawings, there is shown, generally at 10, a preferred embodiment of an improved portable cigarette lighter closure device constructed according to the principles of the present invention. The closure device 10 of the present invention provides facile pivoting of a cover 12 of a portable cigarette lighter 14 between an open position and closed position, and securely retains the cover 12 in the closed position.

The closure device 10 of the present invention incorporates magnetic field radiating means 16, with the north and south poles in the horizontal position, in the cover 12 of the portable cigarette lighter 14, for securing the cover 12 to a body 18 of the lighter 14, to securely retain the cover 12 in the closed position. The magnetic field radiating means 16 radiates a magnetic field of sufficient strength to retain the cover 12 against the lighter's body 18, to maintain the cover 12 in the closed position, while still enabling one handed pivoting of the cover 12 by a user (not shown) for opening the cover 12.

The present invention 10 obviates the need for a spring biased lever, as was common to the prior art, so that the user does not have to exert an excessive amount of force when opening the cover 12. In the present invention, when the user pivots the cover 12 from the closed position to the open position, the force that the magnetic field radiating means 16 exerts on the body 18 of the lighter 14 uniformly decreases to allow facile pivoting of the cover 12 to the open position. When it is desired to pivot the cover 12 from the open position to the closed position, the user rotates the cover 12 toward the body 18. As the cover 12 is rotated toward the body 18, the strength of the magnetic field radiating from the radiating means 16 draws the cover 12 against the body 18, to again securely retain the cover 12 in the closed position.

Figure 2:
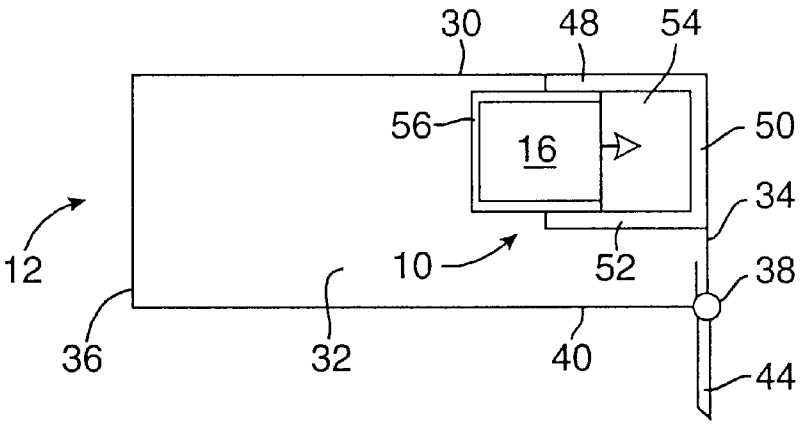
FIG. 2 is a fragmentary, schematic view showing a cover of the portable cigarette lighter embodying the preferred embodiment of the present invention.

Referring more particularly now to FIG. 1 and FIG. 2 of the drawings, the invented device 10 may be incorporated into a portable cigarette lighter of any one of several well known configurations that includes the cover 12 and the body 18. In the preferred embodiment, the closure device of the present invention 10 is incorporated in to a portable cigarette lighter 14, similar to the lighter disclosed in U.S. Pat. No. 2,032,695. Such a portable cigarette lighter 14 typically includes a hollow cover 12 that is pivotably coupled to a hollow body 18. The body 18 is configured to retain a reservoir 20 for holding a flammable lighter fluid. The reservoir 20 may comprise a cell or a portion of an absorbent material, such as felt, that may be slidably disposed within the body 18. The reservoir 20 is in communication with an ignition assembly 22 and via a wick 24.

The ignition assembly 22 includes an upwardly extending draft guard 26 that prevents flames created by the lighter 14 from being inadvertently extinguished. A toothed wheel 28 is provided to engage a flint (not shown). The toothed wheel 28 is rotated to cause the flint to throw sparks into the draft guard 26 and toward the wick 24, for igniting the lighter fluid saturated wick 24 to produce a flame for the user.

The hollow cover 12 includes a top wall or roof 30, a pair of side walls 32, a rear wall 34, and a front wall 36. A hinge 38 is coupled to an edge 40 of the cover's rear wall and to an upper edge 42 of the body 18 along a rear wall 44 thereof, for pivotably coupling the cover 12 to the body 18. During use, the cover 12 is pivoted between a closed position (shown in FIG. 1), wherein the cover 12 is residing on the body 18 and enclosing the ignition assembly 22, and an open position, wherein the front wall 36 of the cover 12 is pivoted away from the body 18 to expose the ignition assembly 22 allowing access thereto.

Figure 3:
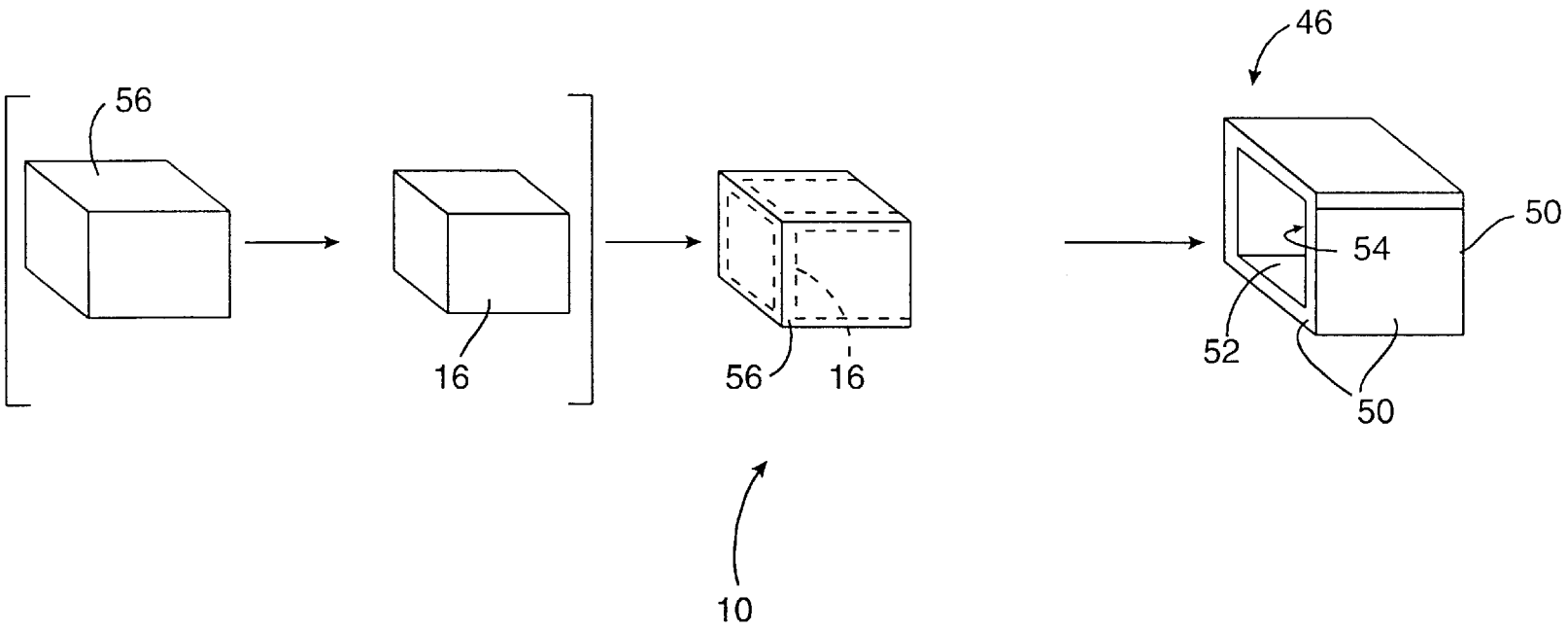
FIG. 3 is an exploded, schematic view of the preferred embodiment of the closure device of the present invention.

Referring again to the drawing Figures, and particularly to FIG. 3, the preferred embodiment of the invented closure device 10 includes the magnetic field radiating means 16 that is positioned in the cover 12 adjacent to the front wall 36 and roof 30 thereof. Most preferably, the magnetic field radiating means 16 is positioned in the cover 12, so that the radiating means 16 is located proximal to the draft guard 26, when the cover 12 is closed (as shown in FIG. 1), without abutting the draft guard 26. The location of the magnetic field radiating means 16 enables the radiating means 16 to exert sufficient magnetic force on the draft guard 26 for retaining the cover 12 in the closed position, while preventing damage from coming to the radiating means 16 due to heating thereof by the draft guard 26. Additionally, when an external force is applied to the cover 12, such as a user pushing upwardly on the cover's front wall 36 to pivot the cover 12 from the closed position to the open position, the magnetic field radiating means 16 is rotated away from the draft guard 26 so that the magnetic force that the radiating means 16 exerts on the draft guard 26 uniformly decreases for allowing facile pivoting of the cover 12 from the closed position to the open position.

In the preferred embodiment of the present invention, the magnetic means 16 comprises a known strong metallic magnetic, hereinafter referred to as a magnet, that is dimensioned to be retained in the interior of the cover 12.

Additionally, the device of the present invention 10 may be provided with means for preventing the magnetic field radiated by the magnet 16 from passing through the cover 12 of the lighter 14. A ferromagnetic insulating sleeve 46 may be interposed between the magnet 16, a portion of the roof 30, and side walls 32 of the cover 12. The ferromagnetic insulating sleeve 46 preferably comprises a portion of a ferromagnetic metal alloy that is approximately 2 mm (millimeters) thick that prevents the magnetic field radiated by the magnet 16 from passing substantially though the cover's roof 30 and side walls 32 to prevent magnetically attracted objects located in a pocket of the user's clothing, such as the users keys and change for example, from being inadvertently drawn against the cover 12.

The sleeve 46 includes a top wall 48 that is affixed to the roof 30 of the cover 12, side walls 50 affixed to the side walls 32 and rear wall 34 of the cover 12, and a bottom wall 52. The configuration of the sleeve's side walls 50 and bottom wall 52 provides an cavity 54 for receiving the antiferromagnetic insulated magnet 16 therein. Additionally, the bottom wall 52 is provided to support the magnet 16, when the cover 12 is closed. Preferably, the magnet 16 is self-affixed to the sleeve's side walls 50 and bottom wall 52, due to the magnetic force that the magnet exerts on the sleeve 46, for securing the magnet 16 to the cover 12.

Additionally, thermal antiferromagnctic insulating means 56 may be provided for preventing harm from coming to the magnet 16, due to the substantial heat radiated by the draft guard 26. In the preferred embodiment, the thermal antiferromagnetic insulating means 56 comprises a hollow box shaped member that is dimensioned to extend about the periphery of the magnet 16. The insulating means 56 is preferably approximately 0.4 millimeter thick and comprises an antiferromagnetic metal alloy, such as aluminum. In the preferred embodiment, the antiferromagnetic insulating means 56 is dimensioned to mate to the periphery of the magnet 16 and is sufficiently thin to enable the magnet 16 and antiferromagnetic insulating means 56 to be disposed in the sleeve's cavity 54.

Thus, there has been described an improved portable cigarette lighter closure device that provides facile pivoting of the cover between open and closed positions, and which securely retains the cover in the closed position is provided. The closure device incorporates a magnet affixed in the cover of a cigarette lighter, for securing the cover to a body of the lighter and to securely retain the cover in the closed position. The magnet exerts sufficient force on the body to retain the cover in the closed position, while enabling one handed pivoting of the cover by the user. Additionally the invention may be provided with a ferromagnetic insulating sleeve. The ferromagnetic sleeve in combination with the antiferromagnetic or ferromagnetic walls of the cover preventing the magnetic field radiated by the magnet from passing through the cover of the lighter, for preventing magnetically attracted objects located in a pocket of the user's clothing, such as the users keys and change for example, from being inadvertently drawn against the cover of the lighter.

Those skilled in the art will appreciate that various adaptations and modifications of the just-described preferred embodiments can be configured without departing from the scope and spirit of the invention. Therefore it is to be understood that, within the scope of the appended claims, the invention may be practiced other than as specifically described herein.

What is claimed is:

1. In a portable cigarette lighter including an ignition assembly mounted on a body, the ignition assembly including an upwardly projecting draft guard, a cigarette lighter closure device comprising:

a cover pivotably coupled to the body, the cover pivotable between an open position and a closed position; and magnetic field radiating means secured in an interior of the cover, the magnetic field radiating means radiating a magnetic field from north and south poles thereof of sufficient strength to draw the radiating means proximal to the draft guard for retaining the cover in the closed position and of sufficient strength to permit pivoting of the cover from the closed position toward the open position when an external force is applied to the cover.

2. The device of claim 1 further including;

a ferromagnetic insulating sleeve interposed between the magnetic field radiating means and selected portions of the interior of the cover, the sleeve inhibiting the magnetic field radiated by the radiating means from passing though the cover to prevent magnetically attracted objects located proximal to the cover from being drawn against an exterior of the cover.

3. The device of claim 2 wherein the magnetic field radiating means is affixed to the sleeve with the sleeve secured to the interior of the cover, for securing the radiating means to the cover.

4. The device of claim 1 wherein magnetic field radiating means comprises a known strong metallic magnet.

5. In a portable cigarette lighter including an ignition assembly mounted on a body, the ignition assembly including an upwardly projecting draft guard, a cigarette lighter closure device comprising:

a hollow cover pivotably coupled to the body, the cover having a top wall, a pair of side walls, a front wall, and a rear wall;

hinge means coupled to an edge of the rear wall and an edge of the body for pivotably coupling the cover to the body, such that the cover extends over the ignition assembly and encloses the draft guard when the cover is in a closed position, the cover pivotable between an open position and the closed position; and magnetic field radiating means secured to an interior of the cover, the magnetic field radiating means positioned in the interior of the cover such that the radiating means is located proximal to the draft guard when the cover is in the closed position for radiating a magnetic field of sufficient magnetic force on the draft guard to maintain the cover in the closed position, the magnetic force that the magnetic field radiating means exerts on the draft guard uniformly decreasing when an external force is applied to the cover for allowing facile pivoting of the cover from the closed position to the open position.

6. The device of claim 5 further including:

a ferromagnetic insulating sleeve affixed to the interior of the cover and to the magnetic field radiating means for securing the radiating means to the cover and a portion of the top wall and side walls of the interior of the cover, the sleeve inhibiting the magnetic field radiated by the radiating means from passing though the cover to prevent magnetically attracted objects located proximal to the lighter from being drawn against an exterior of the cover.

7. The device of claim 5 wherein magnetic field radiating means comprises a known strong magnetic metal alloy.

8. In a portable cigarette lighter including an ignition assembly mounted on a body, the ignition assembly including an upwardly projecting draft guard, a cigarette lighter closure device comprising:

a hollow cover pivotably coupled to the body, the cover having a top wall, a pair of side walls, a front wall, and a rear wall;

hinge means coupled to an edge of the rear wall and an edge of the body for pivotably coupling the cover to the body, such that the cover extends over the ignition assembly and encloses the draft guard when the cover is in a closed position, the cover pivotable between an open position and the closed position;

magnetic field radiating means secured to an interior of the cover, the magnetic field radiating means positioned in the interior of the cover such that the radiating means is located proximal to the draft guard when the cover is in the closed position for radiating a magnetic field from north and south poles thereof of sufficient magnetic force on the draft guard to maintain the cover in the closed position, wherein when an external force is applied to the cover for pivoting the cover from the closed position to the open position, the magnetic field radiating means is rotated away from the draft guard so that the magnetic force that the magnetic field radiating means exerts on the draft guard uniformly decreases for allowing facile pivoting of the cover from the closed position to the open position; and a ferromagnetic insulating sleeve interposed between the magnetic field radiating means and top wall and side walls of the cover for inhibiting the magnetic field radiated by the radiating means from passing though the cover to prevent magnetically attracted objects located proximal to the lighter from being drawn against an exterior of the cover, the sleeve including a top wall, a pair of side walls affixed to the interior of the cover and to the magnetic field radiating means for securing the radiating means to the cover, the sleeve further including a bottom wall for biasing the draft guard downwardly when the cover is in the closed position.

9. The device of claim 8 further comprising thermal antiferromagnetic insulating means for preventing harm from coming to the magnetic field radiating means due to substantial heat radiated by the draft guard.

10. The device of claim 8 wherein the thermal antiferromagnetic insulating means is configured to mate to the periphery of the magnetic field radiating means and to be interposed between the radiating means and magnetic insulating sleeve.

11. The device of claim 10 wherein the thermal insulating means comprises a antiferromagnetic metal alloy and the magnetic insulating sleeve comprises a ferromagnetic metal alloy.

12. The device of claim 11 wherein the thermal antiferromagnetic insulating means is dimensioned to mate to the periphery of the magnetic field radiating means and to be interposed between the radiating means and magnetic insulating sleeve.

13. The device of claim 11 wherein the thermal antiferromagnetic sleeve comprises an aluminum alloy.

14. The device of claim 11 wherein the sleeve comprises steel alloy.

* * * * *